US011538285B2

(12) United States Patent
Haug

(10) Patent No.: US 11,538,285 B2
(45) Date of Patent: Dec. 27, 2022

(54) METHOD FOR FRANKING MAIL ITEMS WHICH ARE FED TO A FRANKING MACHINE, AND DEVICE FOR CARRYING OUT THE METHOD

(71) Applicant: FRAMA AG, Lauperswil (CH)

(72) Inventor: Thomas Peter Haug, Bern (CH)

(73) Assignee: FRAMA AG, Lauperswil (CH)

( * ) Notice: Subject to any disclaimer, the term of this patent is extended or adjusted under 35 U.S.C. 154(b) by 452 days.

(21) Appl. No.: 16/719,187

(22) Filed: Dec. 18, 2019

(65) Prior Publication Data

US 2020/0258319 A1 Aug. 13, 2020

(30) Foreign Application Priority Data

Feb. 11, 2019 (EP) ..... 19405005

(51) Int. Cl.
*G07B 17/00* (2006.01)
*B65H 29/58* (2006.01)

(52) U.S. Cl.
CPC ..... *G07B 17/00508* (2013.01); *B65H 29/58* (2013.01); *G07B 17/00467* (2013.01); *G07B 17/00661* (2013.01); *G07B 2017/0058* (2013.01); *G07B 2017/00524* (2013.01);
(Continued)

(58) Field of Classification Search
CPC ..... G07B 17/00508; G07B 17/00467; G07B 17/00661; G07B 2017/00524; G07B 2017/0058; G07B 2017/00669; G07B 2017/00685; B65H 29/58
See application file for complete search history.

(56) References Cited

U.S. PATENT DOCUMENTS 4,893,249 A 1/1990 Silverberg
5,440,979 A 8/1995 Bonham
(Continued)

FOREIGN PATENT DOCUMENTS

GB 2246117 A 1/1992
WO WO 2017/203219 A1 * 11/2017 ..... B41J 3/407

OTHER PUBLICATIONS

DeDiemar, Nancy L., "Mail shop in a box, part III: Basic equipment configuration," Instant and Small Commercial Printer, 22.3: 22, Libertyville: Innes Publishing Company, Mar. 2003.*

*Primary Examiner* — Nathan Erb
(74) *Attorney, Agent, or Firm* — Lucas & Mercanti, LLP; Klaus P. Stoffel

(57) ABSTRACT

A method for franking mail items fed to a franking machine. The mail items are drawn from the underside of a stack for separation or are fed individually on a conveying section upstream of the franking machine to a printing unit for franking, after franking, are discharged in the opposite direction from the printing unit. The mail items are fed via a diverter section to the conveying section, after franking, are conveyed via the diverter section which is switched over to change the conveying direction into a depositing apparatus below the diverter section. The mail items are guided in the opening region of the franking machine into the printing position and are returned out of the printing position. The printing position of a mail item fed to the printing unit is determined by a print head movement-controlled from a readiness position pursuant to the format length of the mail item.

13 Claims, 4 Drawing Sheets

(52) U.S. Cl.
CPC ..... *G07B 2017/00669* (2013.01); *G07B 2017/00685* (2013.01)

(56) References Cited

U.S. PATENT DOCUMENTS

| | | | | |
|---|---|---|---|---|
| 6,102,534 | A * | 8/2000 | Herbert | G07B 17/00508 347/86 |
| 9,524,517 | B2 * | 12/2016 | McGivney | G06Q 20/18 |
| 9,745,159 | B2 * | 8/2017 | Fulleringer | B65H 7/02 |
| 2005/0171921 | A1 * | 8/2005 | Nicolas | G07B 17/00661 705/406 |
| 2009/0259602 | A1 | 10/2009 | Beckstrom | |
| 2014/0145396 | A1 * | 5/2014 | Hiyama | B65H 29/125 271/225 |

* cited by examiner

METHOD FOR FRANKING MAIL ITEMS WHICH ARE FED TO A FRANKING MACHINE, AND DEVICE FOR CARRYING OUT THE METHOD

CROSS-REFERENCE TO RELATED APPLICATIONS

The present application claims priority of EP 19 40 5005.0, filed Feb. 11, 2019, the priority of this application is hereby claimed and this application is incorporated herein by reference.

BACKGROUND OF THE INVENTION

The invention relates to a method for franking mail items which are fed to a franking machine, such as envelopes, padded envelopes, wrappers, cards, labels, printed products or the like, which mail items are drawn from/on the underside of a stack for separation and/or are fed individually on a conveying section which is connected upstream of the franking machine to a printing unit for printing/franking which belongs to the franking machine, and, after franking, are discharged in the opposite conveying direction from the printing unit, the mail items being fed via a diverter section of the conveying section to the printing unit of the franking machine and, after franking, being conveyed via the diverter section which is switched over in order to change the conveying direction of the mail items into a depositing apparatus which is arranged below the diverter section, the mail items being guided in the opening region of the franking machine into the printing position and being returned out of the printing position after the printing operation.

In the case of one known embodiment of a franking machine for franking or printing mail items (workpieces) of the C5, C5/6 and C6 formats (the latter also called a short letter in the specialist area) but also other formats, the mail items are pushed/plugged in individually by hand and guided on a side edge (short side edge) into a housing opening of the franking machine, which housing opening faces the operator, as far as a stop, at which the printing operation is triggered. The latter takes place after a positioned mail item has been lifted into the printing position below the printing path of the print head in the existing printing apparatus or printing unit of the franking machine.

For the purpose of franking relatively large mail item formats, the housing opening is equipped with a lateral outlet, through which the mail items are ejected or are removed from the franking machine after printing/franking.

If this simple, manually operable franking machine is to be equipped with a feeder for stacked mail items in order to attach a separating apparatus, as described and shown, for example, in EP patent application 18 405 019.3, the C6 mail items (short letter) cannot reach the printing position or cannot be transferred into the printing position and cannot be fetched back from there on account of the short longitudinal edge, because the conveying device which is connected upstream of the franking machine is not configured for a mechanical/frictionally locking transport of the mail items into the printing position and for returning or removing them from the printing apparatus or the franking machine.

SUMMARY OF THE INVENTION

Proceeding herefrom, the present invention has been set the object of developing a franking machine by way of simple means, in order that, in addition to the customary mail item formats, the small C6 formats can also be processed individually from a stack of identical mail item formats or mixed with other mail item formats.

According to the invention, the object has been achieved by virtue of the fact that the printing position of a mail item which is fed in each case to the printing unit is determined by way of the (driven) print head which is movement-controlled from a readiness position in accordance with the format length (length in the conveying direction) of said mail item, with the result that printing processing can be carried out by way of the franking device both in a semi-automatic manner and in a fully automatic and synchronized manner, and in a reliable manner for all format sizes of the mail items, even smaller than the C5/6 DIN format (220×110 mm), for example C6.

The printing operation/the printing path of the print head and its restoring into the readiness position and the defined printing position of a mail item and the removal of the printed/franked mail item advantageously take place by way of a sensor which is fastened to the print head and is connected operatively to a controller/control apparatus.

When the printing position of the mail item is reached in the franking machine, the print head which is controlled in a manner which can be initiated by sensor preferably brings about the printing operation and the subsequent returning of the printed mail item out of the printing position into a depositing apparatus, and the restoring of the print head into the/a readiness position for the following mail item, in a credible user-friendly operating method.

The printing operation for mail items which are smaller than the C5/6 DIN format can also expediently be initiated by way of manual actuation of a button or touchscreen which is connected to the programmed controller control command which is brought about.

The printing operation/printing path is initiated in the readiness position of the print head. It proves to be advantageous if the processing takes place in a manner which is based on the processing cycle of the franking machine/its printing unit or the separating apparatus.

An actuable rest position (service point) for the print head can be connected upstream of the readiness or operating position for the printing operation, in which rest position the print head is situated in a rest position or out-of-operation position, for example in order to service the printing unit.

One alternative possibility for processing mail items in a franking machine according to the present invention consists in that an end stop which is correspondingly position-controlled in the conveying direction of the mail item length is used to determine the printing position of the mail items in the franking machine, with the result that the print head is moved out of the readiness position into the corresponding printing position, even in the case of different mail item lengths, the print head being reset into a readiness position for the next following printing operation or the next following mail item after each printing operation and, in the case of a change of the mail item format, the readiness position for the print head being set correspondingly.

A format length or width of a mail item, which length or width is measured on the conveying path from a separating station/feed station of the mail items which are fed in a stacked manner or individually to the franking machine, can advantageously be used to determine the printing position of a mail item and the readiness position and triggering of the printing path, and the restoring of the print head which is triggered following the printing operation into a readiness position or of the end stop which can be adjusted in a controlled manner, with the result that a trackable processing step can take place in the franking machine.

It proves to be expedient for a printing operation if the mail items are guided below the print head and are firmly held there in a mechanical/frictionally locking manner, in order for it to be possible for them to be printed reliably in the printing unit and removed.

It proves to be a simple measure for disruption-free franking if, in order to control the print head, the printing position of the print head is transferred into the print head position of the print head, which print head position is calculated/determined by the controller, by way of the length of a mail item, which length is measured/detected on the delivery path/on the delivery section.

To this end, the mail item length can be measured on the conveying section between one or two measuring points, for example LS1 and LS2, or further measuring points, and the measured result can be transmitted to the controller in order to position the print head for the printing operation or to determine the printing position in the franking machine.

The spacing between two measuring points on the conveying section is less than or at least the length of the shortest mail item to be processed (for example, C6 format), to which end covering of the two measuring points by way of the mail item is necessary.

As an alternative, in the case of only one light barrier, the length of the mail item which passes through can be measured by means of the circumference of a driven conveying roller, directly after the separation.

A device for franking mail items which are fed to a franking machine, such as envelopes, padded envelopes, wrappers, cards, labels, printed products or the like, which mail items are drawn from/on the underside of a stack for separation and/or are fed individually on a conveying section of a conveying device which is connected upstream of the franking machine to a printing unit for franking which has a print head, and, after franking, are discharged in the opposite conveying direction from the printing unit, the mail items being fed via a diverter section to the conveying section of the franking machine and, after franking, being conveyed via the diverter section which is switched over in order to change the conveying direction of the mail items depositing apparatus which is arranged, the mail items being guided in the opening region of the franking machine into the printing position and being returned out of the printing position, the printing position of a mail item which is fed in each case to the printing unit being determined by way of the print head which is movement-controlled from a readiness position in accordance with its format length; which device allows, in particular, mail items of a smaller format size than C5/6 and other format sizes to be printed/franked.

The processing can be optimized further if the opening region into the printing unit of the franking machine is configured by way of a holding apparatus which acts in a mechanical or frictionally locking manner on the mail items in the printing position, preferably after printing, advantageously in the end region of the mail item which is fed to the printing unit.

For the sake of simplicity, the holding apparatus is configured by way of a pair of conveying rollers which are arranged above one another, form a conveying nip, and reliably guide the mail item which is transported via the diverter section into the printing tray.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

FIGS. 1 to 4 show a franking device 1 for printing/franking mail items 2 such as envelopes, padded envelopes, wrappers, cards, labels, printed products or the like, of different format sizes, for example the C4 to C6 format sizes and other formats.

A device of the same generic type is disclosed by the unpublished document EP 18 405 019.5.

Figure 1:
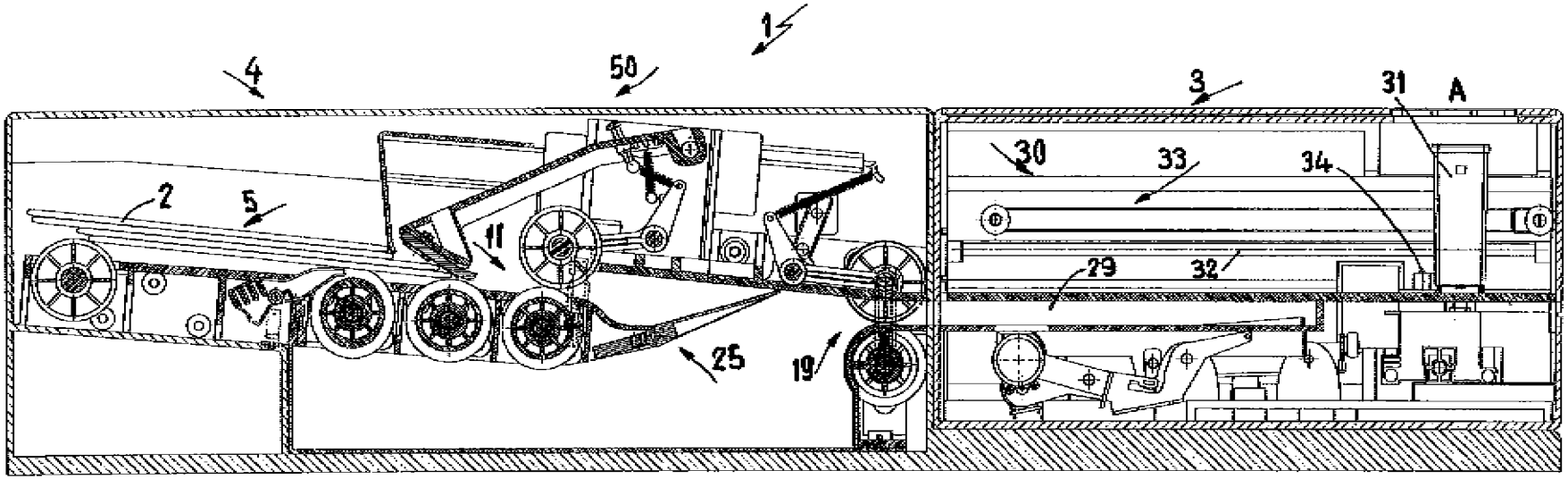
FIG. 1 shows a longitudinal section through a franking device (viewed in the conveying direction of the mail items) which is formed from a separating apparatus and a franking machine which is connected operatively in terms of conveying, for processing mail items of the abovementioned type, in a starting position.

As illustrated in FIG. 1, the present franking device 1 consists of a machine for printing or franking mail items 2 (called a franking machine 3), and a separating apparatus 4 which is connected upstream of said machine and in which the mail items 2 are fed in a stack 5 or individually, it being possible for the mail items 2 to be processed/franked to also have different thickness dimensions.

Figure 2:
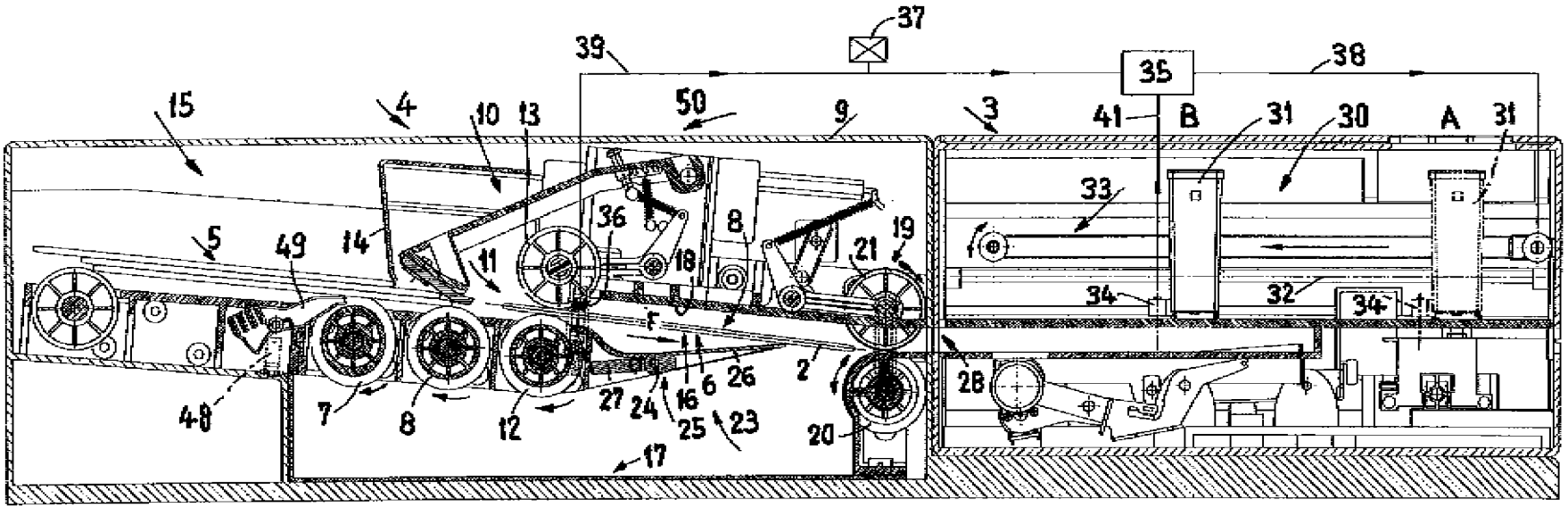
FIG. 2 shows the franking device according to FIG. 1, the lowermost mail item of a stack having left the separating apparatus in the direction of the franking machine, and the print head awaiting the control command in a readiness position of the franking machine.

FIG. 2 shows the device 1 after the lowermost mail item 2 has been drawn off from a stack 5. The mail item 2 which is drawn off is situated on a conveying section 6 which connects the separating apparatus 4 to the franking machine 3.

In the region of the separating apparatus 4, the conveying section 6 has two conveying rollers 7, 8 which guide the separated mail items 2 in a manner which lies on them and so as to form a slightly inclined conveying plane, which conveying rollers 7, 8 have the same circumference in the present case, are arranged behind one another transversely with respect to the conveying direction F, and are driven in the same direction in accordance with the arrow direction. The conveying rollers 7, 8 are mounted at lateral ends in a housing 9 or frame.

The mail items 2 are first of all gripped on the conveying roller 8 by way of a setting member 10 of the separating apparatus 4.

As soon as the mail item 2 which is drawn off is gripped by the conveying rollers 7, 8 and the setting member 10, it is transported further and is guided between the conveying roller pair 11 which follows on the conveying plane/conveying section which is formed, of which conveying roller pair 11 at least the lower conveying roller 12 is driven, and the upper conveying roller 13 is arranged so as to rotate freely, so as to lie in a yielding manner on the lower conveying roller 12, and so as to form a frictionally locking conveying nip with said lower conveying roller 12.

The mail items 2 which are submitted for processing reach the separating apparatus 4 with the front edge (in the transport direction F) in a positionally correct and oriented manner by way of an inclined guide face 14 of a feeder 15, which guide face 14 extends over the width of the conveying plane. A feeder of this type is described in EP 18 405 019.3 which was mentioned at the outset.

FIG. 2 shows a conveying plane 16 on the conveying section 6, which conveying plane 16 ends in front of or in the franking machine 3 with the printing position of a mail item 2. A space is available below the conveying section 6 between the separating apparatus 4 or its end and the franking machine 3, which space is provided as a depositing apparatus 7 for the mail items 2 which are conveyed away backwards out of the franking machine 3 after printing, and is delimited towards the top by way of a guide plate 18.

The opening of the conveying section 6 at/from the franking machine 3 is configured by way of a conveying roller pair 19 which is arranged above one another and forms a conveying nip which runs transversely with respect to the conveying direction F, a lower conveying roller 20 being driven, and the upper conveying roller 21 which is supported on the said lower conveying roller 20 being pressed down by way of a yielding spring force.

The conveying roller pair 19 has approximately the circumferential speed of the conveying roller pair 11 which is connected upstream of it, and receives the transported mail item 2.

The depositing apparatus 17 which is situated below the guide plate 18 has a delivery floor 22 for the printed mail items 2 which are ejected backwards from the franking machine 3 and are delivered there above one another.

A diverter 23 which can be switched over and guides the mail items is arranged at a spacing above the delivery floor 22 and below the guide plate 18, which diverter 23 serves firstly for the mail items 2 which are intended for franking to reach the franking machine 3 without disruption on the conveying path between the separating apparatus 4 and said franking machine 3, and secondly, after printing, to keep the return path of the mail items 2 free out of the franking machine 3 into the depositing apparatus 17 below the diverter 23.

The diverter 23 (actuating apparatus) which is shown in the figures consists of a diverter tongue 25 which can be pivoted about an approximately horizontal axis 24 which runs transversely with respect to the transport direction F of the mail items 2, which diverter tongue 25 can be pivoted upwards automatically by way of an inhomogeneous weight distribution on the axis 24, and can preferably be pivoted/set against the guide plate 18, with the result that an upwardly directed deflecting effect is produced with respect to a guide tongue 26 which sweeps over the fed mail items 2 at the free end of the diverter tongue 25 and the heavier counterweight 27 on the side which lies opposite on the axis 24, the mail items 2 which pass through counteracting said deflecting effect and thus forming a guiding aid.

It goes without saying that the diverter tongue 25 might also be driven by motor (in a synchronously coordinated manner in accordance with the transport of the mail items), in particular in order to process thin mail items 2 which have an unstable stiffness for the downwardly acting movement of the guide tongue 26 of the diverter tongue 25, away from the guide plate 18, in order to form a conveying nip.

The upwardly deflecting diverter tongue 25 also serves for the mail items 2 which are to be fed to the depositing apparatus 17 from the franking machine 3, or keeps their conveying path into the depositing apparatus 17 free. That is to say, the mail items 2 which are fed to the franking machine 3 glide along or between the guide plate 18 and the guide tongue 26 or on the conveying section 16 between the conveying rollers 20, 21, and are transported by the latter through housing openings 28 of the assembled conveying device 50 in the franking machine 3 into the franking machine 3.

There is the possibility to connect or attach a conveying device 50 or separating apparatus 4 upstream of the independent franking machine 3 which is shown for a manual operation with individual mail items 2, with the result that automatic processing of the mail items 2 which are fed in a stack or individually can or also be performed individually directly via the franking machine 3.

FIGS. 1 to 4 show the franking device 1 which interacts/is combined with a separating apparatus 4 and a franking machine 3.

FIG. 1 shows the franking device 1 in an out-of-operation state. A horizontal open printing tray 29 which forms the end of the conveying section 6 and to which the mail items 2 are fed in each case individually is part of a printing unit 30 which is arranged in the franking machine 3.

According to FIG. 1, the print head 31 of the printing unit 30, which print head 31 can be moved on horizontal guide rails 32 by means of a flexible drive 33, is situated in a preliminary starting position A, from which it is moved before the printing operation/printing path into a readiness position B (see FIG. 2). The flexible drive 33 which is configured from a stepping motor or actuating motor or electric motor of this type is connected to a controller/control apparatus 35 which transmits the corresponding position to the flexible drive 33/motor on the basis of measured or fixed data.

On the front side which faces the front edge of the incoming mail item 2, the print head 31 has a sensor 34 which is connected to the controller 35 and by means of which the mail item 2 which has arrived in the printing tray 29 and/or the printing position triggers a signal which is directed to the controller 35 for a control command, and the required electric drive energy is fed to the printing unit 30, by the printing path of the print head 31 out of the readiness position B, the printing operation/printing path of the print head 31, and the restoring movement of the print head 31 into the readiness position B and the delivery of the printed mail item 2 by way of reversing of the conveying roller pair 19 being brought about, in this sequence.

FIG. 2 shows the situation, in which the print head 31 is moved from the starting position A (indicated using dash-dotted lines) into the readiness position B and a mail item 2 is situated on the conveying section 6 in the direction F of the franking machine 3, where it is directly subsequently gripped by way of the conveying roller pair 19 upstream of the franking machine 3, is introduced in a frictionally locking manner into the open printing tray 29 which is directed towards the conveying section 6, and is held firmly in the intended printing position.

Upon the arrival or detection of a mail item 2 by way of the sensor 34 (light barrier), the printing operation/printing path of the print head 31 is triggered and afterwards (as has already been mentioned) the print head 31 is moved back into the readiness position B by way of the controller 35, and the printed mail item 2 which has remained gripped in the conveying roller pair 19 during the printing operation is discharged out of the printing tray 29 into the depositing apparatus 17 by means of reversing of the driven conveying roller pair 19.

Subsequently, the cycle is repeated at least on the "short letters" or mail items 2 of C6 format or smaller.

Figure 3:
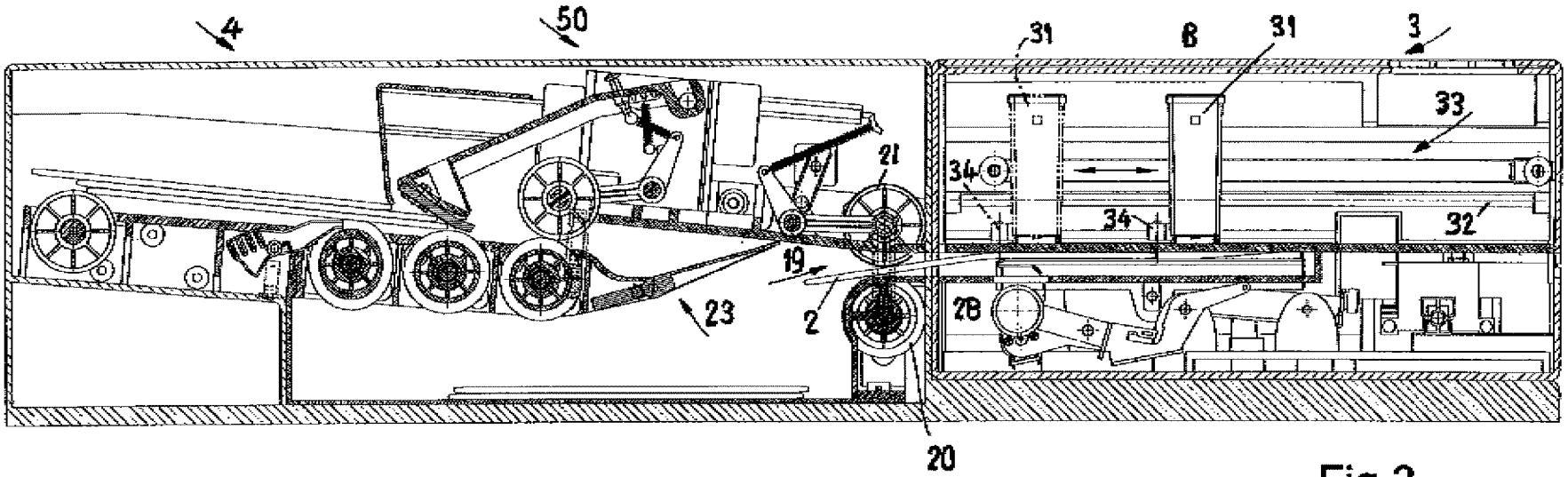
FIG. 3 shows the franking device with the mail item which has arrived in the printing position in the meantime and is held firmly, and the print head (shown using dashed-dotted lines) which is moved further out of the readiness position according to FIG. 2 during the printing operation.

FIG. 3 shows a mail item 2 which is fed to the printing position in the printing tray 29 before the printing operation/printing path, and the print head 31 (with a continuous line) in the readiness position B, the relevant mail item 2 having remained clamped in between the conveying rollers 20, 21 of the conveying roller pair 19 during the printing operation, and being freed from the conveying rollers 20, 21 after the printing or for feeding of the depositing apparatus 17 by way of a reversing movement of said conveying rollers 20, 21.

FIG. 3 further uses dash-dotted lines to show the end position of the print head 31 after the printing operation or after the printing path has been covered. The double arrow symbolizes the printing movement and the restoring movement of the print head 31 into the readiness position B.

The latter can preferably be adapted or adjusted automatically to the mail item formats.

Figure 4:
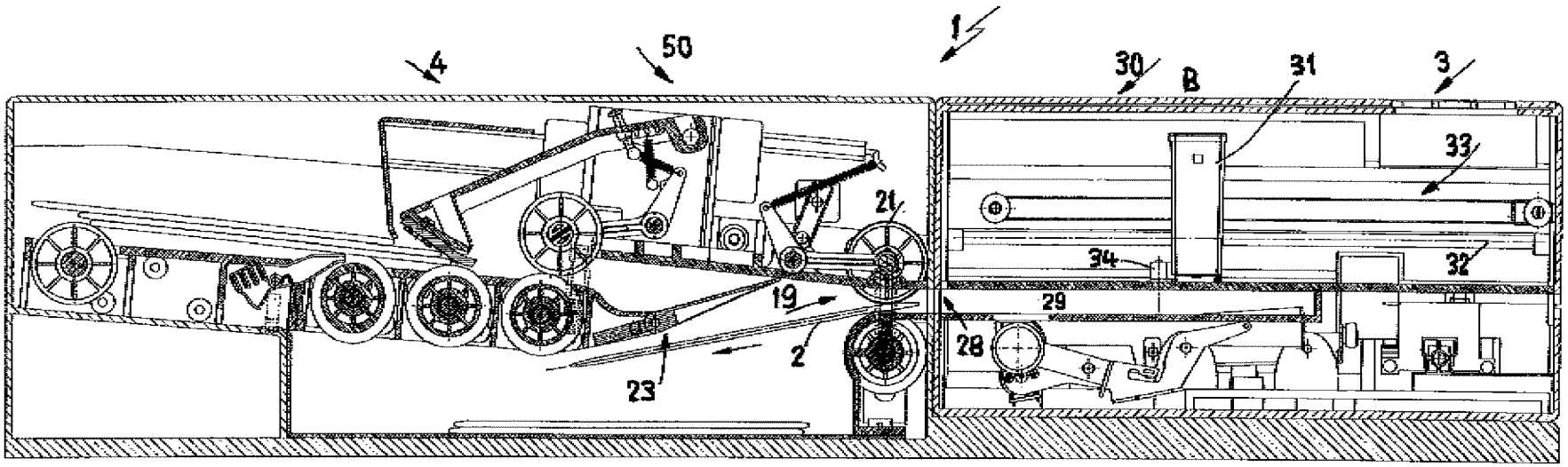
FIG. 4 shows the print head which is set back into the readiness position, and the mail item which is conveyed (back)/rejected in the direction of a depositing apparatus after the printing operation.

FIG. 4 illustrates the franking device 1 after the printing operation in the case of a print head 31 which has been reset into the readiness position B and in the case of a reversed conveying movement of the conveying rollers 20, 21 for the transport of a mail item 2 counter to the feed direction out of the franking machine 3 or its printing unit 30 into the depositing apparatus 17, in the case of a raised (switched-over) diverter tongue 25.

FIG. 2 shows the controller or control apparatus 35 symbolically.

A light barrier 36 which is connected to the controller 35 is arranged as a pulse/signal transmitter of a measuring point LS1 on the conveying section 6, preferably directly in front of or behind the conveying roller pair 11 in the conveying direction F, which light barrier 36, in the case of the entry of the front edge of a mail item 2, transmits a first signal to the controller and, in the case of the exit of the rear edge of the mail item 2, transmits a further signal to the controller which is configured for the measurement of the length of a mail item 2 which passes through on the conveying section 6, and forwards the corresponding printing and position information to the print head 31 or flexible drive 33 on the basis of the values which are measured at the measuring point. The control line 38 is provided for the transmission of the drive energy. The signal transmission of the light barrier 36 on the conveying section 6 to the controller 35 takes place via control line 39.

As has already been described further above, the processing in the franking machine or the franking, in particular of mail items 2 of C5/6 size or smaller, can be performed via a manual actuation of a button or touchscreen 40 which is connected to the controller 35, which button or touchscreen 40 is connected by cable to the controller 35 which sets the print head 31 into the corresponding readiness position via the sensor 34 before the printing path, the sensor 34 forwarding the arrival of a mail item 2 via a signal line 41 to the controller 35 and thus triggering the printing operation.

As an alternative, the processing can take place automatically by way of placing of the mail items 2 in the separating apparatus 4 via a letter triggering lever 49. Here, the letter triggering lever 49 outputs a control pulse via a light barrier 48 to the controller 35 which triggers the processing or the franking.

While specific embodiments of the invention have been shown and described in detail to illustrate the inventive principles, it will be understood that the invention may be embodied otherwise without departing from such principles.

I claim:

1. A method for franking mail items which are fed to a franking machine, comprising the steps of:

drawing the mail items from/on an underside of a stack for separation by a separating apparatus and/or feeding the mail items individually in a conveying direction on a conveying section connected upstream of the franking machine to a printing unit;

franking the mail items in the printing unit with a print head;

discharging the mail items from the printing unit after franking in a direction opposite the conveying direction, the mail items being fed via a diverter section to the conveying section of the franking machine and, after franking, being conveyed via the diverter section being switched over to change the conveying direction of the mail items into a depositing apparatus arranged below the diverter section, the mail items being guided in an opening region of the franking machine into a printing position and being returned out of the printing position; and determining the printing position of each mail item that is fed to the printing unit by way of the print head which is movement-controlled from a readiness position in accordance with a format length of the mail item, including carrying out a printing operation with the print head and restoring the print head into the readiness position and determining the printing position of the mail item and removal of the franked mail item by way of a sensor fastened to the print head and connected to a controller, including initializing the printing operation for mail items with a smaller format size than C5/6 by manually actuating a button or a touchscreen connected to the controller or by a control command brought about by a mail item triggering levers of the separating apparatus.

2. The method according to claim 1, wherein, when the printing position of the mail item is reached in the franking machine, the print head, which is controlled in a manner that is initiated by the sensor, brings about the printing operation and a subsequent return of the franked mail item out of the printing position into the depositing apparatus, and restoring of the print head into the readiness position.

3. The method according to claim 1, wherein the method proceeds in a manner based on a processing cycle of the franking machine, the printing unit or the separating apparatus.

4. The method according to claim 1, including initializing a printing operation in the readiness position of the print head.

5. The method according to claim 1, wherein the print head is movable out of a rest position into the readiness position and back again.

6. The method according to claim 1, including measuring a length or a width of the mail item on a conveying path to the franking machine, and using the measured length or width to determine the printing position of the mail item and the readiness position and triggering of the print head, and the restoring the print head after the printing operation and the returning of the printed mail item.

7. The method according to claim 6, including determining a printing path or a printing position of the print head from the length of the mail item, which length is measured on the conveying path and is transmitted to the controller of the franking machine.

8. The method according to claim 6, including measuring the length of the mail item on the conveying section at one or between two measuring points, and transmitting the measured result to the controller to determine the readiness position of the print head and the printing position of the mail item.

9. The method according to claim 8, wherein a spacing between the two measuring points corresponds to less than the length of a shortest mail item intended for franking.

10. The method according to claim 1, including firmly holding the mail items in the printing position in a mechanical or frictionally locking manner with a returning apparatus during the printing operation.

11. A device, comprising:

a franking machine including a printing unit with a controlled print head that franks mail items;

a conveying device connected upstream of the franking machine to transport mail items drawn off from an underside of a stack in a separating apparatus or fed in individually, the conveying device having a conveying section;

a diverter arranged on the conveying section to feed the mail items to the printing unit, and, after a printing operation, to return the mail items in an opposite conveying direction into a depositing apparatus;

a control apparatus that controls the print head; and a sensor attached to the print head and connected to the control apparatus, the sensor being arranged to face a front end of the mail item which is guided into a printing position of the franking machine, the control apparatus controlling the print head in response to signals from the sensor;

wherein:

the diverter returns the mail items via being switched over to change the conveying direction of the mail items into the depositing apparatus, which is arranged below the diverter; and the printing position of each mail item that is fed to the printing unit is determined by way of the print head, which is movement-controlled from a readiness position in accordance with a format length of the mail item, including carrying out the printing operation with the print head and restoring the print head into the readiness position and determining the printing position of the mail item and removal of the franked mail item by way of the sensor, including initializing the printing operation for mail items with a smaller format size than C5/6 by manually actuating a button or a touchscreen connected to the control apparatus or by a control command brought about by a mail item triggering levers of the separating apparatus.

12. The device according to claim 11, further comprising a returning apparatus that configures an opening region into the printing unit of the franking machine and holds the mail items in the printing position.

13. The device according to claim 12, wherein the returning apparatus includes a pair of conveying rollers including a first roller arranged above a second roller so as to hold the mail items in each case in the printing position in a mechanical or frictionally locking manner.

* * * * *